US009703221B2

(12) United States Patent
Hori

(10) Patent No.: US 9,703,221 B2
(45) Date of Patent: Jul. 11, 2017

(54) TONER

(71) Applicant: KYOCERA Document Solutions Inc., Osaka (JP)

(72) Inventor: Hideharu Hori, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/112,862

(22) PCT Filed: Feb. 10, 2015

(86) PCT No.: PCT/JP2015/053620
§ 371 (c)(1),
(2) Date: Jul. 20, 2016

(87) PCT Pub. No.: WO2015/122402
PCT Pub. Date: Aug. 20, 2015

(65) Prior Publication Data

US 2016/0342102 A1 Nov. 24, 2016

(30) Foreign Application Priority Data

Feb. 12, 2014 (JP) ..... 2014-024103

(51) Int. Cl.
*G03G 9/087* (2006.01)
*G03G 9/093* (2006.01)
*G03G 9/08* (2006.01)

(52) U.S. Cl.
CPC ..... *G03G 9/09328* (2013.01); *G03G 9/0821* (2013.01); *G03G 9/0827* (2013.01); *G03G 9/09392* (2013.01)

(58) Field of Classification Search
CPC ..... G03G 9/08751; G03G 9/09307; G03G 9/09371
See application file for complete search history.

(56) References Cited

U.S. PATENT DOCUMENTS

| | | | |
|---|---|---|---|
| 7,910,278 | B2 | 3/2011 | Ohta et al. |
| 2005/0271964 | A1 | 12/2005 | Etou et al. |
| 2007/0269733 | A1 | 11/2007 | Ohta et al. |

FOREIGN PATENT DOCUMENTS

| | | | |
|---|---|---|---|
| JP | H01-219846 | A | 9/1989 |
| JP | 2004-138985 | A | 5/2004 |

(Continued)

OTHER PUBLICATIONS

Translation of JP 2014-048341 published Mar. 2014.*

(Continued)

*Primary Examiner* — Peter Vajda
(74) *Attorney, Agent, or Firm* — Studebaker & Brackett PC

(57) ABSTRACT

A toner according to the present invention includes a plurality of toner particles each including a toner core and a shell layer disposed over a surface of the toner core. The shell layer contains a thermosetting resin. A ratio $G^*_1/G^*_2$ of complex modulus $G^*_1$ at 120° C. of a pellet formed using the toner relative to complex modulus $G^*_2$ at 120° C. of the toner is at least 2.0 and no greater than 3.0. The pellet is obtained by forming the toner into a size of 0.5 mm in thickness and 10 mm in diameter under forming conditions of 25° C. and 50 kg·f/cm$^2$.

8 Claims, 2 Drawing Sheets

(56) References Cited

FOREIGN PATENT DOCUMENTS

| | | | | | |
|---|---|---|---|---|---|
| JP | 2004-151638 | A | | 5/2004 | |
| JP | 2004-294468 | A | | 10/2004 | |
| JP | 2004-294469 | A | | 10/2004 | |
| JP | 2005-275146 | A | | 10/2005 | |
| JP | 2006-195106 | A | | 7/2006 | |
| JP | 2011-039110 | A | | 2/2011 | |
| JP | 2014-048341 | | * | 3/2014 | ..... G03G 9/08 |
| JP | 2014-048341 | A | | 3/2014 | |
| WO | 2006/070870 | A1 | | 7/2006 | |

OTHER PUBLICATIONS

International Search Report issued in PCT/JP2015/053620; mailed Apr. 14, 2015.
Written Opinion issued in PCT/JP2015/053620; mailed Apr. 14, 2015.
International Preliminary Report on Patentability issued in PCT/JP2015/053620; issued Mar. 17, 2016.

* cited by examiner

TONER

TECHNICAL FIELD

The present invention relates to a toner.

BACKGROUND ART

Regarding toners, capsule toners are known. A capsule toner includes toner cores and shell layers (capsule layers) formed on surfaces of the toner cores. For example, Patent Literature 1 describes a capsule toner in which shell layers contain a thermosetting resin.

CITATION LIST

Patent Literature

Patent Literature 1

Japanese Patent Application Laid-Open Publication No. 2004-138985

SUMMARY OF INVENTION

Technical Problem

It is difficult to obtain a toner that is excellent both in high-temperature preservability and in low-temperature fixability with the technique disclosed in Patent Literature 1.

In view of the above-mentioned problem, the present invention has been made to provide a toner that is excellent both in high-temperature preservability and in low-temperature fixability.

Solution to Problem

A toner according to the present invention includes a plurality of toner particles each including a toner core and a shell layer disposed over a surface of the toner core. The shell layer contains a thermosetting resin. A ratio $G^*_1/G^*_2$ of complex modulus $G^*_1$ at 120° C. of a pellet formed using the toner relative to complex modulus $G^*_2$ at 120° C. of the toner is at least 2.0 and no greater than 3.0. The pellet is obtained by forming the toner into a size of 0.5 mm in thickness and 10 mm in diameter under forming conditions of 25° C. and 50 kg·f/cm$^2$.

Advantageous Effects of Invention

The present invention can provide a toner that is excellent both in high-temperature preservability and in low-temperature fixability.

DESCRIPTION OF EMBODIMENTS

Figure 1:
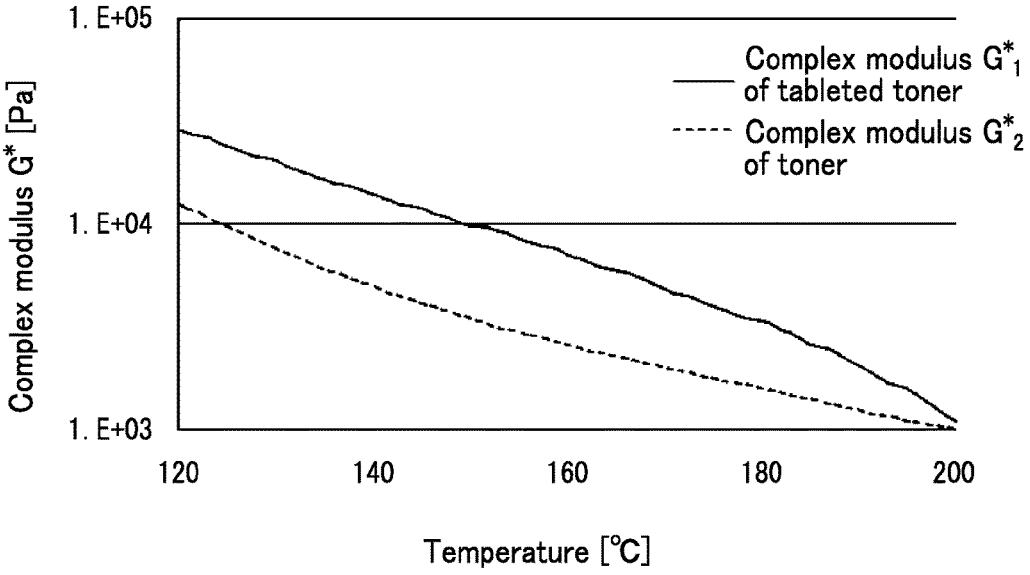
FIG. 1 shows a relationship between complex modulus $G^*_1$ and temperature, and a relationship between complex modulus $G^*_2$ and temperature with respect to a toner according to Preparation Example (A-1).

The following describes an embodiment of the present invention in detail. However, the present invention is not in any way limited by the following embodiment and appropriate changes may be made when practicing the present invention within the intended scope of the present invention. Although description is omitted as appropriate in some instances in order to avoid repetition, such omission does not limit the essence of the present invention.

A toner according to the present embodiment is an electrostatic latent image developing capsule toner. The toner according to the present embodiment is a powder including a plurality of particles (hereinafter, referred to as toner particles). The toner according to the present embodiment can be used, for example, in an image forming apparatus.

The following describes an example of a method by which an electrophotographic apparatus forms an image. First, an electrostatic latent image is formed on a photosensitive member based on image data. Next, the formed electrostatic latent image is developed using a two-component developer that includes a carrier and a toner. In a development process, charged toner is caused to adhere to the electrostatic latent image. The adhered toner is transferred to a transfer belt, and subsequently a toner image on the transfer belt is further transferred to a recording medium (for example, paper). Thereafter, the toner is heated in order to fix the toner to the recording medium. Through the method described above, an image is formed on the recording medium. A full-color image can for example be obtained by superimposing toner images formed using toners of four colors: black, yellow, magenta, and cyan.

The following describes composition of the toner (in particular, toner particles) according to the present embodiment.

Preferably, the toner particles each include a toner core, a shell layer (capsule layer) disposed over a surface of the toner core, and an external additive. Hereinafter, the term "toner mother particles" is used to refer to toner particles prior to adhesion of an external additive.

The toner core preferably contains a binder resin and an internal additive (for example, a colorant and a releasing agent). The toner core is coated by the shell layer. Preferably, the external additive adheres to the surface of the shell layer. Note that the internal additive or the external additive may be omitted depending on the intended use of the toner. Furthermore, a plurality of shell layers may be layered on the surface of the toner core.

The toner according to the present embodiment has a ratio ($G^*_1/G^*_2$) of complex modulus $G^*_1$ at 120° C. of the toner when pelletized (of a pellet obtained by tableting the toner) relative to complex modulus $G^*_2$ at 120° C. of the toner of at least 2.0 and no greater than 3.0 (preferably, at least 2.1 and no greater than 2.6). Conditions for forming the toner into a pellet (conditions for tableting the toner) are a temperature of 25° C. and an applied pressure of 50 kg·f/cm$^2$. Thus, a pellet (tablet) having a size of 0.5 mm in thickness and 10 mm in diameter is obtained. In the present description and the claims, pelletizing a toner to obtain a pellet may be referred to as "tableting". The unit of the complex modulus $G^*_1$ and the complex modulus $G^*_2$ is Pa (pascal).

A toner having a $G^*_1/G^*_2$ value of at least 2.0 has excellent high-temperature preservability because the shell layers therein have improved heat resistance. Furthermore, a toner having a $G^*_1/G^*_2$ of no greater than 3.0 has excellent low-temperature fixability.

A ratio (tan $\delta_1$/tan $\delta_2$) of loss tangent tan $\delta_1$ at 120° C. of the pellet relative to loss tangent tan $\delta_2$ at 120° C. of the toner according to the present embodiment is preferably at least 0.30 and no greater than 0.50, and more preferably at least 0.33 and no greater than 0.49. Regarding measurement of tan $\delta_1$, tableting conditions for forming the toner into a pellet and the size of the pellet are the same as in the measurement of the complex modulus $G^*_1$.

In order that $G^*_1/G^*_2$ or tan $\delta_1$/tan $\delta_2$ is within the above-specified range, the thickness of the shell layers and the thermosetting resin to be included in the resin forming the shell layers can be selected or adjusted as appropriate.

The toner according to the present embodiment preferably includes at least 80% by number of toner particles according to the present embodiment, more preferably at least 90% by number of toner particles according to the present embodiment, and still more preferably 100% by number of toner particles according to the present embodiment.

Preferably, the toner cores are anionic and the shell layers are cationic. As a result of the toner cores being anionic, a cationic shell layer material can be attracted toward the surfaces of the toner cores during formation of the shell layers. More specifically, for example, the shell material that is positively charged in an aqueous medium is electrically attracted toward the toner cores that are negatively charged in the aqueous medium, and shell layers are formed on the surfaces of the toner cores through in-situ polymerization. As a result, the toner cores are not excessively dispersed in the aqueous medium through use of a dispersant, and the shell layers tend to be readily formed on the surfaces of the toner cores in a uniform manner.

The binder resin is typically a main component (for example, at least 85% by mass) of toner core components in the toner cores. Consequently, polarity of the toner cores is largely influenced by polarity of the binder resin. The toner cores have a higher tendency to be anionic in a situation in which the binder resin has, for example, an ester group, a hydroxyl group, an ether group, an acid group, or a methyl group, and have a higher tendency to be cationic in a situation in which the binder resin has, for example, an amino group, an amine, or an amide group.

In the present embodiment, the toner cores having a negative zeta potential when measured in an aqueous medium adjusted to pH 4 is taken as an indicator that the toner cores are anionic. In order that the toner cores and the shell layers bond more strongly to one another, the toner cores preferably have a zeta potential at pH 4 of less than 0 V and the toner particles preferably have a zeta potential at pH 4 of greater than 0 V. Note that in the present embodiment, a pH of 4 is the same as the pH of the aqueous medium during formation of the shell layers.

Examples of methods for measuring the zeta potential include an electrophoresis method, an ultrasound method, and an electric sonic amplitude (ESA) method.

The electrophoresis method involves applying an electrical field to a liquid dispersion of particles, thereby causing electrophoresis of electrically charged particles in the dispersion, and calculating the zeta potential based on the rate of electrophoresis. An example of the electrophoresis method is laser Doppler electrophoresis (a method in which migrating particles are irradiated with laser light and the rate of electrophoresis of the particles is determined from an amount of Doppler shift of scattered light that is obtained). Advantages of laser Doppler electrophoresis are a lack of necessity for particle concentration in the dispersion to be high, a low number of parameters being necessary for calculating the zeta potential, and a good degree of sensitivity in detection of the rate of electrophoresis.

The ultrasound method involves irradiating a liquid dispersion of particles with ultrasound, thereby causing vibration of electrically charged particles in the dispersion, and calculating the zeta potential based on an electric potential difference that arises due to the vibration.

The ESA method involves applying a high frequency voltage to a liquid dispersion of particles, thereby causing electrically charged particles in the dispersion to vibrate and generate ultrasound. The zeta potential is then calculated based on the magnitude (intensity) of the ultrasound.

An advantage of the ultrasound method and the ESA method is that the zeta potential can be measured to a good degree of sensitivity even when particle concentration of the dispersion is high (for example, exceeding 20% by mass).

Preferably, neither the toner cores nor the shell layers in the present embodiment contain a dispersant (surfactant). Dispersants typically have a high effluent load. In a configuration in which a dispersant is not used, the amount of water used during a toner washing process can be reduced. Also, in a configuration in which a dispersant is not used, the total organic carbon concentration of effluent discharged during manufacture of the toner particles can be restricted to a low level of no greater than 15 mg/L without diluting the effluent.

The organic component (for example, unreacted monomer, prepolymer, or dispersant) of an effluent can be measured by measuring biochemical oxygen demand (BOD), chemical oxygen demand (COD), or total organic carbon (TOC) concentration. In particular, measurement based on the TOC concentration enables reliable measurement of all organic substances. Also, by measuring the TOC concentration, the amount of an organic component in the effluent (i.e., all filtrates and washing fluids produced after reaction) which does not contribute to capsulation (i.e., formation of the shell layers) can be determined.

The following describes, in order, the toner cores (binder resin and internal additive), the shell layers, and the external additive.

[Toner Cores]

The toner cores include a binder resin and an internal additive (a colorant, a releasing agent, a charge control agent, or a magnetic powder). Some components (for example, a colorant, a releasing agent, a charge control agent, and a magnetic powder) may be omitted depending on the intended use of the toner.

(Binder Resin)

The following describes the binder resin.

In order that the binder resin is strongly anionic, the binder resin preferably has a hydroxyl value (OHV) and an acid value (AV) that are each at least 10 mg KOH/g, and more preferably each at least 20 mg KOH/g.

The binder resin preferably has a glass transition point (Tg) that is no greater than a curing onset temperature of the shell layer material. Use of such a binder resin tends to ensure sufficient fixability, even during high speed fixing of the toner. The thermosetting resin (in particular, a melamine-based resin) typically has a cure onset temperature of approximately 55° C. The binder resin preferably has a Tg of at least 20° C., more preferably at least 30° C. and no greater than 55° C., and still more preferably at least 30° C. and no greater than 50° C. As a result of Tg of the binder resin being at least 20° C., the toner cores have a low tendency to aggregate during shell layer formation.

The binder resin preferably has a softening point (Tm) of no greater than 100° C., and more preferably no greater than 95° C. Tm of the binder resin being no greater than 100° C. (more preferably no greater than 95° C.) enables sufficient fixability of the toner even during high speed fixing. Furthermore, in a situation in which Tm of the binder resin is no greater than 100° C. (more preferably no greater than 95°

C.), partial softening of the toner cores tends to occur during a curing reaction of the shell layers when the shell layers are formed on the surfaces of the toner cores in an aqueous medium and, as a result, the toner cores tend to become round in shape due to surface tension. Note that Tm of the binder resin can be adjusted by combining a plurality of resins each having a different Tm.

The following describes a method of reading Tg of the binder resin from a heat absorption curve.

For measuring Tg of the binder resin, a heat absorption curve of the binder resin is plotted using a differential scanning calorimeter (for example, "DSC-6220", product of Seiko Instruments Inc.). Tg of the binder resin can be obtained from a point of change of specific heat on the heat absorption curve of the binder resin.

The following describes a method of reading Tm of the binder resin from an S-shaped curve.

Tm of the binder resin can be measured using a capillary rheometer (for example, "CFT-500D", product of Shimadzu Corporation). More specifically, a measurement sample is set in the capillary rheometer, and melt-flow of the sample is caused under specific conditions. Through the above, an S-shaped curve (S-shaped curve of temperature (° C.)/stroke (mm)) is obtained. Tm of the binder resin can be read from the thus obtained S-shaped curve. In the S-shaped curve, $S_1$ represents a maximum stroke value and $S_2$ represents a base line stroke value at low temperatures. Tm of the measurement sample is a temperature on the S-shaped curve corresponding to a stroke value of $(S_1+S_2)/2$.

Preferably, the binder resin for example has an ester group, a hydroxyl group, an ether group, an acid group, a methyl group, or a carboxyl group as a functional group. The binder resin preferably has a functional group such as a hydroxyl group or a carboxyl group in molecules thereof, and more preferably has either or both of a hydroxyl group and a carboxyl group in molecules thereof. Toner cores (binder resin) having a functional group such as described above readily reacts with the shell layer material (for example, methylol melamine) to form chemical bonds. Formation of such chemical bonds ensures strong bonding between the toner cores and the shell layers.

Preferably, the binder resin is a thermoplastic resin. Examples of preferable thermoplastic resins include styrene-based resins, acrylic acid-based resins, styrene-acrylic acid-based resins, polyethylene-based resins, polypropylene-based resins, vinyl chloride-based resins, polyester resins, polyamide-based resins, urethane-based resins, polyvinyl alcohol-based resins, vinyl ether-based resins, N-vinyl-based resins, and styrene-butadiene-based resins. In particular, styrene-acrylic-based resins and polyester resins have excellent properties in terms of colorant dispersibility in the toner, chargeability of the toner, and fixability of the toner on a recording medium.

The following describes a styrene-acrylic acid-based resin as the binder resin. The styrene-acrylic acid-based resin is a copolymer of a styrene-based monomer and an acrylic-based monomer.

Examples of preferable styrene-based monomers include styrene, α-methylstyrene, p-hydroxy styrene, m-hydroxy styrene, vinyltoluene, α-chlorostyrene, o-chlorostyrene, m-chlorostyrene, p-chlorostyrene, and p-ethylstyrene.

Examples of preferable acrylic-based monomers include (meth)acrylic acid, alkyl esters of (meth)acrylic acid, and hydroxyalkyl esters of (meth)acrylic acid. Examples of preferable alkyl esters of (meth)acrylic acid include methyl (meth)acrylate, ethyl (meth)acrylate, n-propyl (meth)acrylate, iso-propyl (meth)acrylate, n-butyl (meth)acrylate, iso-butyl (meth)acrylate, and 2-ethylhexyl (meth)acrylate. Specific examples of preferable hydroxyalkyl esters of (meth) acrylic acid include 2-hydroxyethyl (meth)acrylate, 3-hydroxypropyl (meth)acrylate, 2-hydroxypropyl (meth) acrylate, and 4-hydroxybutyl (meth)acrylate. Furthermore, the term "(meth)acrylic acid" is used as a generic term for both acrylic acid and methacrylic acid.

A hydroxyl group can be introduced into the styrene-acrylic acid-based resin by using a monomer having a hydroxyl group (examples include p-hydroxystyrene, m-hydroxystyrene, and hydroxyalkyl esters of (meth)acrylic acid) in preparation of the styrene-acrylic acid-based resin. The hydroxyl value of the styrene-acrylic acid-based resin to be prepared can be adjusted by adjusting the amount of the monomer having the hydroxyl group that is used.

A carboxyl group can be introduced into the styrene-acrylic-based resin by using (meth)acrylic acid as a monomer during preparation of the styrene-acrylic-based resin. The acid value of the styrene-acrylic acid-based resin to be prepared can be adjusted by adjusting the amount of (meth) acrylic acid that is used.

The styrene-acrylic acid-based resin as the binder resin preferably has a number average molecular weight (Mn) of at least 2,000 and no greater than 3,000 in order to improve toner core strength and toner fixability. The styrene-acrylic-based resin preferably has a molecular weight distribution (ratio Mw/Mn of mass average molecular weight (Mw) relative to number average molecular weight (Mn)) of at least 10 and no greater than 20. Mn and Mw of the binder resin can be measured by gel permeation chromatography.

The following describes a polyester resin as the binder resin. The polyester resin can be prepared through polymerization of a di-, tri-, or higher-hydric alcohol with a di-, tri-, or higher-basic carboxylic acid.

Examples of preferable di-, tri-, or higher-hydric alcohols that can be used in preparation of the polyester resin include diols, bisphenols, and alcohols having three or more hydroxyl groups.

Examples of preferable diols include ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol.

Examples of preferable bisphenols include bisphenol A, hydrogenated bisphenol A, polyoxyethylene bisphenol A ether, and polyoxypropylene bisphenol A ether.

Examples of preferable alcohols having three or more hydroxyl groups include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of di-basic carboxylic acids include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acids (more specifically, n-butylsuccinic acid, isobutylsuccinic acid, n-octylsuccinic acid, n-dodecylsuccinic acid, and isododecylsuccinic acid), and alkenyl succinic acids (more specifically, n-butenylsuccinic acid, isobutenylsuccinic acid, n-octenylsuccinic acid, n-dodecenylsuccinic acid, and isododecenylsuccinic acid).

Examples of preferable tri- or higher-basic carboxylic acids include 1,2,4-benzenetricarboxylic acid (trimellitic acid), 1,2,5-benzenetricarboxylic acid, 2,5 ,7-naphthalenetric arboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, and EMPOL trimer acid.

An ester-forming derivative (for example, an acid halide, acid anhydride, or lower alkyl ester) of any of the di-, tri-, or higher-basic carboxylic acids listed above may be used. The term "lower alkyl" refers to an alkyl group having from one to six carbon atoms.

The acid value and the hydroxyl value of the polyester resin can be adjusted by adjusting the amounts of the di-, tri-, or higher-hydric alcohol and the di-, tri-, or higher-basic carboxylic acid used in preparation of the polyester resin. An increase in the molecular weight of the polyester resin tends to cause a decrease in the acid value and the hydroxyl value of the polyester resin.

The polyester resin as the binder resin preferably has a number average molecular weight (Mn) of at least 1,200 and no greater than 2,000 in order to improve toner core strength and toner fixability. The polyester resin preferably has a molecular weight distribution (ratio Mw/Mn of mass average molecular weight (Mw) relative to number average molecular weight (Mn)) of at least 9 and no greater than 20.

(Colorant)

The toner cores may contain a colorant as an internal additive. For example, a known pigment or dye that matches the color of the toner particles can be used as the colorant. The amount of the colorant is preferably at least 1 part by mass and no greater than 20 parts by mass relative to 100 parts by mass of the binder resin, and more preferably at least 3 parts by mass and no greater than 10 parts by mass.

The toner cores of the toner particles according to the present embodiment may contain a black colorant. The black colorant is for example composed of carbon black. Alternatively, a colorant that has been adjusted to be black in color using colorants such as a yellow colorant, a magenta colorant, and a cyan colorant may be used as the black colorant.

The toner cores of the toner particles according to the present embodiment may contain a non-black colorant such as a yellow colorant, a magenta colorant, or a cyan colorant.

Preferably, the yellow colorant for example includes a condensed azo compound, an isoindolinone compound, an anthraquinone compound, an azo metal complex, a methine compound, or an arylamide compound. Examples of preferable yellow colorants include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G, and C.I. Vat Yellow.

Preferably, the magenta colorant for example includes a condensed azo compound, a diketopyrrolopyrrole compound, an anthraquinone compound, a quinacridone compound, a basic dye lake compound, a naphthol compound, a benzimidazolone compound, a thioindigo compound, or a perylene compound. Examples of preferable magenta colorants include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

Preferably, the cyan colorant for example includes a copper phthalocyanine compound, a copper phthalocyanine derivative, an anthraquinone compound, or a basic dye lake compound. Examples of preferable cyan colorants include C.I. Pigment Blue (1, 7, 15, 15:1, 15:2, 15:3, 15:4, 60, 62, and 66), Phthalocyanine Blue, C.I. Vat Blue, and C.I. Acid Blue.

(Releasing Agent)

The toner cores may contain a releasing agent as an internal additive. The releasing agent is used in order to improve fixability of the toner or resistance of the toner to being offset. The amount of the releasing agent is preferably at least 1 part by mass and no greater than 30 parts by mass relative to 100 parts by mass of the binder resin, and more preferably at least 5 parts by mass and no greater than 20 parts by mass in order to improve the fixability and the offset resistance.

Examples of preferable releasing agents include: aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax and block polymer of polyethylene oxide wax; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes having a fatty acid ester as a main component such as montanic acid ester wax and castor wax; and waxes in which a fatty acid ester is partially or fully deoxidized such as deoxidized carnauba wax.

(Charge Control Agent)

The toner cores may contain a negatively chargeable charge control agent as an internal additive. The charge control agent is used in order to improve charging stability or a charge rise characteristic of the toner and to obtain a toner having excellent durability or stability. The charge rise characteristic is an indicator as to whether the toner can be charged to a specific charge level in a short period of time.

(Magnetic Powder)

The toner cores may contain a magnetic powder as an internal additive. Examples of preferable magnetic powders include iron (for example, ferrite or magnetite), ferromagnetic metals (for example, cobalt or nickel), alloys including either or both of iron and a ferromagnetic metal, compounds including either or both of iron and a ferromagnetic metal, ferromagnetic alloys subjected to ferromagnetization such as heat treatment, and chromium dioxide.

[Shell Layers]

The shell layers contain a thermosetting resin. A toner including toner particles having the shell layers are excellent in high-temperature preservability and low-temperature fixability. More specifically, the shell layers tend not to rupture during storage or transportation. On the other hand, during fixing of the toner, the shell layers tend to readily rupture upon application of heat and pressure and the toner cores (for example, binder resin) rapidly soften or melt. Therefore, the toner can be fixed to a recording medium at low temperatures.

The shell layers may for example contain a positively chargeable charge control agent.

Shell layer formation is preferably carried out in an aqueous medium in order to prevent dissolution of the binder resin and in order to prevent elution of the releasing agent during the shell layer formation. Therefore, the the shell layer material is preferably water-soluble.

Examples of preferable thermosetting resins include melamine resins, urea resins, sulfonamide resins, glyoxal resins, guanamine resins, aniline resins, and derivatives of these resins.

A thermosetting resin for example includes nitrogen atoms in a molecular backbone thereof. Other preferable examples of thermosetting resins include polyimide resins, maleimide-based polymers, bismaleimide, amino-bismaleimide, and bismaleimide-triazine.

The thermosetting resin is particularly preferably a resin (referred to below as an aminoaldehyde resin) produced through polycondensation of an amino group-containing compound and an aldehyde (for example, formaldehyde), or a derivative of an aminoaldehyde resin. The melamine resin is a polycondensate of melamine and formaldehyde. The urea resin is a polycondensate of urea and formaldehyde. The glyoxal resin is a polycondensate of formaldehyde and a reaction product of glyoxal and urea. The glyoxal resin is preferably dimethylol dihydroxyethyleneurea (DMDHEU).

Cross-link curing by the thermosetting resin can be improved through inclusion of nitrogen atoms in the thermosetting resin. In order to increase reactivity of the thermosetting resin, nitrogen content is preferably adjusted to at least 40% by mass and no greater than 55% by mass for a melamine resin, approximately 40% by mass for a urea resin, and approximately 15% by mass for a glyoxal resin.

The thermosetting resin contained in the shell layers is preferably prepared using one or more thermosetting monomers selected from the group consisting of methylol melamine, melamine, methylol urea, urea, benzoguanamine, acetoguanamine, and spiroguanamine.

In the shell layer formation, a curing agent or a reaction accelerator may be used, and a polymer incorporating a plurality of functional groups may be used. Furthermore, an acryl-silicone resin (graft polymer) may be used in order to improve water resistance of the shell layers.

The shell layers preferably have a thickness of no greater than 20 nm, and more preferably at least 3 nm and no greater than 20 nm in order to control the $G^*_1/G^*_2$ value or the tan $\delta_1$/tan $\delta_2$ value within a preferable range.

In a situation in which the thermosetting resin included in the resins forming the shell layers is a melamine resin, the shell layers preferably have a thickness of at least 3 nm and no greater than 20 nm in order to control the $G^*_1/G^*_2$ value and the tan $\delta_1$/tan $\delta_2$ value within a preferable range.

If the shell layers have a thickness of greater than 20 nm, the shell layers tend not to rupture even when pressure is applied during fixing of the toner to a recording medium. In such a situation, softening or melting of the binder resin or the releasing agent contained in the toner cores does not proceed rapidly, thereby making it difficult to fix the toner to the recording medium at low temperatures. On the other hand, if the shell layers are too thin (less than 3 nm), the shell layers are weak and may rupture due to impact, for example during transportation. In a situation in which the toner is stored at a high temperature, toner particles including shell layers that have at least partially ruptured tend to aggregate. The reason for the above is that at high temperatures, components such as the releasing agent tend to exude to the surface of the toner particles through ruptured parts of the shell layers.

The thickness of the shell layers can be measured through analysis of cross-sectional TEM images of the toner particles using commercially available image analysis software. The commercially available image analysis software is for example WinROOF (product of Mitani Corporation). More specifically, two straight lines that perpendicularly intersect at approximately the center of a cross-section of the toner are drawn and lengths of four segments where the two straight lines intersect the shell layer are measured. The thickness of the shell layer of a measurement target toner particle is taken to be an average value of the measured lengths of the four segments. Such shell layer thickness measurement is performed for at least 10 toner particles to obtain an average value of shell layer film thicknesses for the measurement target toner particles. The average value is taken to be the film thickness of the shell layers of the toner particles.

In a situation in which the shell layer is too thin, it may be difficult to measure the thickness of the shell layer due to an interface between the shell layer and the toner core being unclear in a TEM image. In such a situation, the thickness of the shell layer can be measured using a combination of TEM imaging and energy dispersive X-ray spectroscopic analysis (EDX) to perform mapping in a TEM image of an element that is characteristic of a shell layer material (for example, nitrogen) to clarify the interface between the shell layer and the toner core.

[External Additive]

The following describes the external additive. The external additive is for example used in order to improve fluidity or handleability of the toner. In order to improve fluidity or handleability of the toner, the amount of the external additive is preferably at least 0.5 parts by mass and no greater than 10 parts by mass relative to 100 parts by mass of the toner mother particles, and more preferably at least 2 parts by mass and no greater than 5 parts by mass.

Examples of preferable external additives include silica and metal oxides (for example, alumina, titanium oxide, magnesium oxide, zinc oxide, strontium titanate, or barium titanate).

In order to improve fluidity and handleability, the external additive preferably has a particle diameter of at least 0.01 μm and no greater than 1.0 μm.

The following describes a method for manufacturing the toner according to the present embodiment. First, in the method for manufacturing the toner according to the present embodiment, the toner cores are formed. Next, at least a thermosetting material and the toner cores are added to a liquid. Next, shell layers containing the thermosetting material are formed on the surfaces of the toner cores in the liquid. The $G^*_1/G^*_2$ value can be adjusted by controlling the thickness of the shell layers to be formed on the surfaces of the toner cores based on the amount of the thermosetting material to be added.

More specifically, ion exchanged water is prepared as the liquid. Next, pH of the liquid is adjusted using an acid (for example, hydrochloric acid or nitric acid). Next, a shell layer material (material for obtaining a thermosetting resin) is added to the liquid. As a result, the shell layer material is dissolved in the liquid to obtain a solution. An appropriate amount of the shell layer material to be added can be calculated based on the specific surface area of the toner cores. Addition of the shell layer material is for example performed at room temperature.

Next, the toner cores are added to the resultant solution, and the solution is heated under stirring. For example, in the present invention, the solution is heated to 70° C. over 30 minutes at a heating rate of 1° C./minute. Thus, the shell layer material adheres to the surfaces of the toner cores, and curing of the adhered material occurs through a polymerization reaction.

In a situation in which the temperature of the solution reaches or exceeds a glass transition point (Tg) of the toner cores, the toner cores transform in terms of shape.

For example, in a situation in which Tg of the binder resin of the toner cores is 45° C. and the thermosetting material contained in the shell layers is a monomer or prepolymer of a melamine resin, heating of the solution to approximately 50° C. causes a curing reaction of the shell layer material to proceed rapidly and the toner cores to transform in terms of shape. When the shell layer material is caused to react at high temperatures, hard shell layers tend to be formed. Also, the toner cores transform more readily in terms of shape with increasing temperature of the liquid, thereby tending to yield toner mother particles that are more spherical. Therefore, the reaction temperature is preferably determined in order to obtain toner mother particles of a desired shape.

Next, the solution is neutralized, cooled, and then filtered. Through the above, the toner mother particles are separated from the liquid (solid-liquid separation). Next, the resultant toner mother particles are dried. Thereafter, the external additive is caused to adhere to the surfaces of the toner mother particles by a known method. Through the above, a toner including a plurality of toner particles is formed.

Preferably, a filtrate of the filtration of the solution has an electrical conductivity of no greater than 10 μS/cm so that there is no effect on chargeability of the toner. The electrical conductivity of the filtrate is for example measured using Horiba COND METER ES-51 (product of HORIBA, Ltd.).

The toner according to the present invention described above is excellent both in high-temperature preservability and in low-temperature fixability, and therefore can be favorably used in various image forming apparatuses.

EXAMPLES

The following provides more specific description of the present invention through use of Examples. Note that the present invention is not in any way limited by the following examples.

Preparation Example (A-1)

Preparation of Toner Cores

A mixer (FM mixer) was used to mix 5 parts by mass of a colorant (C.I. Pigment Blue 15:3, copper phthalocyanine) and 5 parts by mass of an ester wax ("WEP-3", product of NOF Corporation, glass transition point: 70° C.) relative to 100 parts by mass of a polyester resin (acid value: 40 mgKOH/g, hydroxyl value: 20 mgKOH/g, Tm: 100° C., Tg: 48° C.) to give a mixture. Tm was measured as described above based on an S-shaped curve obtained using a capillary rheometer ("CFT-500", product of Shimadzu Corporation). Tg was measured as described above from a heat absorption curve obtained using a differential scanning calorimeter ("DSC-6220", product of Seiko Instruments Inc.). The acid value and the hydroxyl value were measured in accordance with Japanese Industrial Standard (JIS) K0070 using a mixed solvent of acetone and toluene (acetone:toluene=1:1, ratio by volume) as a measurement solvent.

Next, the resultant mixture was melt-kneaded using a twin-screw extruder ("PCM-30", product of Ikegai Corp.) to give a kneaded product. The kneaded product was pulverized using a mechanical pulverizer ("Turbo Mill", product of FREUND-TURBO CORPORATION) to give a pulverized product. The pulverized product was classified using a classifier ("Elbow Jet", product of Nittetsu Mining Co., Ltd.) to give toner cores having a volume median diameter ($D_{50}$) of 6.0 μm. The volume median diameter of the toner cores was measured using Coulter Counter Multisizer 3 (product of Beckman Coulter, Inc.). A sample of the toner cores was taken in order to measure triboelectric charge with a standard carrier and zeta potential in a pH 4 dispersion. The toner cores had a triboelectric charge of −20 μC/g with the standard carrier (N-01) and a zeta potential of −15 mV in the pH 4 dispersion, which clearly indicated that the toner cores were anionic.

The toner cores had a Tg of 49° C. and a Tm of 90° C. The toner cores had a roundness of 0.93.

Shell Layer Formation

After 300 mL of ion exchanged water was added to a 1 L three-necked flask equipped with a thermometer and a stirring impeller, the internal temperature of the flask was maintained at 30° C. using a water bath. Next, the aqueous medium in the flask was adjusted to pH 4 through addition of dilute hydrochloric acid to the flask. After pH adjustment, 2 mL of an aqueous solution of hexamethylol melamine prepolymer ("MIRBANE (registered Japanese trademark) resin SM-607", product of Showa Denko K.K., solid concentration: 80% by mass) was added to the flask as a raw material for the shell layers. The flask contents were subsequently stirred to dissolve the shell layer raw material in the aqueous medium to yield an aqueous solution (A) of the shell layer raw material.

To the three-necked flask containing the aqueous solution (A), 300 g of the toner cores were added and the flask contents were stirred for 1 hour at a speed of 200 rpm. Next, 300 mL of ion exchanged water was added to the flask and the internal temperature of the flask was raised to 70° C. at a rate of 1° C./minute under stirring at 100 rpm. Once the temperature had increased to 70° C., the flask contents were stirred for a further 2 hours at 100 rpm at 70° C. Next, the flask contents were adjusted to pH 7 through addition of sodium hydroxide. The flask contents were subsequently cooled to room temperature to yield a dispersion containing toner mother particles.

A wet cake of the toner mother particles was collected from the toner mother particle-containing dispersion through filtration using a Buchner funnel. A filtrate of the filtration had an electrical conductivity of 4 μS/cm. The toner mother particles were washed by dispersing the wet cake of the toner mother particles in ion exchanged water. The filtrate and the washing fluid had a total organic carbon (TOC) concentration of no greater than 8 mg/L. The filtrate and the washing fluid having such a TOC concentration can be clarified to a level of tap water (TOC concentration: 3 mg/L) through common treatment with a reverse osmosis (RO) membrane.

Next, the toner mother particles were dried by hot-air drying. The toner mother particles had a shell layer thickness of 6 nm.

External Addition Process

An FM mixer (product of Nippon Coke & Engineering Co., Ltd.) having a capacity of 10 L was used to mix 100 parts by mass of the dried toner mother particles and 0.5 parts by mass of silica ("REA90", product of Nippon Aerosil Co., Ltd.) as an external additive for 5 minutes to cause the silica to adhere to the surfaces of the toner mother particles. Next, sifting was performed using a 200 mesh sieve (opening 75 μm) to yield a toner according to Preparation Example (A-1).

Preparation Examples (A-2)-(A-5)

Toners according to Preparation Examples (A-2)-(A-5) were obtained in the same manner as in Preparation Example (A-1) except that the thickness of the shell layers was changed as shown in Table 1 by changing the amount of the aqueous solution of the hexamethylol melamine prepolymer for each of the toners.

Preparation Example (A-6)

A toner according to Preparation Example (A-6) was obtained in the same manner as in Preparation Example (A-1) except that 2 mL of an aqueous solution of methylol urea ("MIRBANE (registered Japanese trademark) resin SU-100", product of Showa Denko K.K., solid concentration: 80% by mass) was used in the shell layer formation instead of 2 mL of the aqueous solution of the hexamethylol melamine prepolymer.

Preparation Example (B-1)

A toner according to Preparation Example (B-1) was obtained in the same manner as in Preparation Example (A-1) except that the thickness of the shell layers was changed to 2 nm by reducing the amount of the aqueous solution of the hexamethylol melamine prepolymer.

Preparation Example (B-2)

A toner according to Preparation Example (B-2) was obtained in the same manner as in Preparation Example (A-1) except that the thickness of the shell layers was changed to 25 nm by increasing the amount of the aqueous solution of the hexamethylol melamine prepolymer.

Each of the resultant toners was evaluated and measured according to the following methods.

(1) Method for Measuring Dynamic Viscoelasticity (Complex Modulus $G^*_1$, Storage Elastic Modulus $G_1$, Loss Elastic Modulus $G_2$, and Loss Tangent tan $\delta_1$) of Tableted Toner (Pellet)

The dynamic viscoelasticity of the toners that were tableted (pellets) was measured using a viscoelasticity measuring device (rheometer "MCR-301", product of Anton Paar GmbH). With respect to each of the toners according to the Preparation Examples, 0.5 g of the toner was loaded on the bottom of a measurement container (having a cylindrical shape with an inner diameter of 2.8 cm) such that the thickness thereof was uniform. A parallel plate having a diameter of 10 cm was pressed against the toner loaded on the bottom of the measurement container at a temperature of 25° C. and a pressure of 50 kg·f/cm$^2$ to form a pellet having a thickness of 0.5 mm±0.02 mm and a diameter of 10 mm. A plate was operated on the pellet at a frequency of 1 Hz and an applied strain logarithmically increased from 0.01% to 5% within a measurement temperature range to measure torque at a measurement temperature of 120° C. With respect to Preparation Example (A-1), the temperature of the pellet was raised to 200° C. at 4° C./minute, and the dynamic viscoelasticity thereof was measured at 20° C. increments. The loss tangent tan δ was calculated in accordance with the following equation.

$$\text{Loss tangent } \tan\delta = \text{Loss elastic modulus } G_2 / \text{Storage elastic modulus } G_1$$

(2) Measurement of Dynamic Viscoelasticity (Complex Modulus $G^*_2$, Storage Elastic Modulus $G_1$, Loss Elastic Modulus $G_2$, and Loss Tangent tan $\delta_2$) of Toner The above-mentioned viscoelasticity measuring device was used to measure the dynamic viscoelasticity of the toners as described below. With respect to each of the toners obtained according to the Preparation Examples, the toner was poured into a measurement plate and closest packed through several times of tapping. Next, the measurement plate was heated to 120° C. to cause the toner to be fused to the measurement plate. A plate was moved downward so as to give a plate gap of 5 mm, and toner spilled from the measurement plate was scraped out. A plate was operated on the toner remaining in the measurement plate at a frequency of 1 Hz and an applied strain logarithmically increased from 0.01% to 5% within a measurement temperature range to measure torque at a measurement temperature of 120° C. With respect to Preparation Example (A-1), the temperature of the toner was raised to 200° C. at 4° C./minute, and the dynamic viscoelasticity thereof was measured at 20° C. increments.

(3) Shell Layer Thickness

Cross-sectional TEM photographs of toner particles included in the toner were recorded according to the following method. The shell layer thickness was determined from the cross-sectional TEM photographs of the toner particles.

<Method for Recording Cross-Sectional TEM Photographs of Toner Particles>

First, the toner was dispersed in a cold-setting epoxy resin and left to stand for 2 days at an ambient temperature of 40° C. to yield a hardened material. The hardened material was dyed using osmium tetroxide. Next, a flake sample of 200 nm in thickness for observation of toner particle cross-sections was cut from the resultant hardened material using a microtome ("EM UC6", product of Leica Microsystems). The resultant flake sample was observed using a transmission electron microscope (TEM, "JSM-6700F", product of JEOL Ltd.) at magnifications of ×3,000 and ×10,000, and TEM photographs of toner particle cross-sections were recorded.

(4) High-Temperature Preservability

Toner for high-temperature preservability evaluation was obtained by weighing 3 g of the toner into a plastic container having a capacity of 30 mL and leaving the toner to stand for 3 hours in a thermostatic chamber set to 60° C. Next, the toner for high-temperature preservability evaluation was sifted in accordance with a manual of a powder tester (product of Hosokawa Micron Corporation) under conditions of a rheostat level of 5 and a time of 30 seconds, using a 325 mesh sieve (opening: 45 μm). The mass of toner remaining on the sieve after sifting was measured. The degree of aggregation (%) was determined in accordance with the following equation from the mass of the toner prior to sifting and the mass of the toner remaining on the sieve after sifting.

$$\text{Degree of Aggregation (\%)} = (\text{Mass of Toner Remaining on Sieve} / \text{Mass of Toner Prior to Sifting}) \times 100$$

(5) Low-Temperature Fixability

A printer ("FS-05250DN", product of KYOCERA Document Solutions Inc.) equipped with a roller-roller type heat pressure fixing device (nip width 8 mm) and thus modified to enable adjustment of fixing temperature was used as an evaluation apparatus. A two-component developer for low-temperature fixability evaluation was prepared by mixing a developer carrier (carrier for TASKalfa5550, product of KYOCERA Document Solutions Inc.) and 10% by mass of the toner relative to the mass of the carrier for 30 minutes using a ball mill ("BALL MILL, ANZ-51S", product of NITTO KAGAKU CO., Ltd.).

The toner was added into a cyan toner container of the evaluation apparatus, and the two-component developer was added into a cyan development section of the evaluation apparatus. The evaluation apparatus was used to convey 90 g/m$^2$ recording paper at a linear velocity of 200 mm/second and form a 1.0 mg/cm$^2$ toner image (in cyan) on the recording paper. Subsequently, the recording paper having the toner image formed thereon was caused to pass through the fixing device. The recording paper passed through the nip over 40 milliseconds. The fixing temperature was set to a range of from 100° C. to 200° C. More specifically, the fixing temperature of the fixing device was raised from 100° C. in increments of 5° C. to fix the unfixed solid image. The minimum temperature at which the solid image could be fixed to the paper without experiencing offset (minimum fixing temperature) was measured.

Measurement results and evaluation results of the toners are shown in Table 1.

TABLE 1

| | | | Preparation Example (A-1) | Preparation Example (A-2) | Preparation Example (A-3) | Preparation Example (A-4) | Preparation Example (A-5) | Preparation Example (A-6) | Preparation Example (B-1) | Preparation Example (B-2) |
|---|---|---|---|---|---|---|---|---|---|---|
| Shell layer | Type of resin | | Melamine resin | Melamine resin | Melamine resin | Melamine resin | Melamine resin | Urea resin | Melamine resin | Melamine resin |
| | Thickness | nm | 6 | 3 | 4 | 10 | 20 | 6 | 2 | 25 |
| Toner | $G^*_1$ | Pa | $2.86 \times 10^4$ | $2.76 \times 10^4$ | $2.79 \times 10^4$ | $2.90 \times 10^4$ | $2.98 \times 10^4$ | $2.81 \times 10^4$ | $2.70 \times 10^4$ | $3.10 \times 10^4$ |
| | $G^*_2$ | Pa | $1.24 \times 10^4$ | $1.38 \times 10^4$ | $1.36 \times 10^4$ | $1.13 \times 10^4$ | $1.03 \times 10^4$ | $1.21 \times 10^4$ | $1.42 \times 10^4$ | $1.00 \times 10^4$ |
| | $G^*_1/G^*_2$ | | 2.3 | 2.0 | 2.1 | 2.6 | 2.9 | 2.3 | 1.5 | 3.1 |
| | $Tan\delta_1$ | | 0.69 | 0.71 | 0.56 | 0.70 | 0.60 | 0.61 | 0.80 | 0.51 |
| | $Tan\delta_2$ | | 1.61 | 1.45 | 1.71 | 1.48 | 1.64 | 1.65 | 1.38 | 1.75 |
| | $Tan\delta_1/Tan\delta_2$ | | 0.43 | 0.49 | 0.33 | 0.47 | 0.37 | 0.37 | 0.58 | 0.29 |
| High-temperature preservability | | % | 10 | 28 | 21 | 9 | 5 | 25 | 45 | 3 |
| Low-temperature fixability | | ° C. | 140 | 135 | 135 | 145 | 155 | 140 | 135 | 180 |

Figure 2:
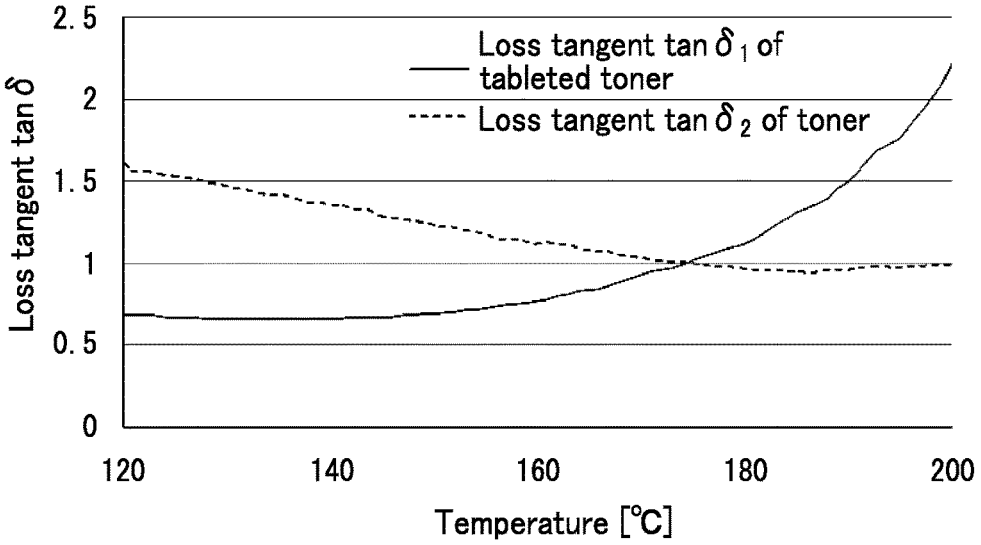
FIG. 2 shows a relationship between loss tangent tan $\delta_1$ and temperature, and a relationship between loss tangent tan $\delta_2$ and temperature with respect to the toner according to Preparation Example (A-1).

Furthermore, with respect to the toner according to Preparation Example (A-1), FIG. 1 shows a relationship between the complex modulus $G^*_2$ of the toner (non-tableted toner) and temperature, and a relationship between the complex modulus $G^*_1$ of the pellet and temperature. In FIG. 1, the vertical axis represents complex modulus and the horizontal axis represents temperature. Furthermore, with respect to the toner according to Preparation Example (A-1), FIG. 2 shows a relationship between the loss tangent tan $\delta_2$ of the toner (non-tableted toner) and temperature, and a relationship between the loss tangent tan $\delta_1$ of the pellet and temperature. In FIG. 2, the vertical axis represents loss tangent and the horizontal axis represents temperature.

As obvious from Table 1, the toners according to Preparation Examples (A-1)-(A-6) (toners according to the present embodiment) achieved both high-temperature preservability and low-temperature fixability.

The toner according to Preparation Example (B-1) had a $G^*_1/G^*_2$ value smaller than 2.0 and therefore is considered inferior in high-temperature preservability.

The toner according to Preparation Example (B-2) had a $G^*_1/G^*_2$ value greater than 3.0 and therefore is considered inferior in low-temperature fixability.

INDUSTRIAL APPLICABILITY

The toner according to the present invention can for example be used for forming images in a copier or a printer.

The invention claimed is:

1. A toner comprising a plurality of toner particles each including a toner core and a shell layer disposed over a surface of the toner core, wherein the toner core contains a polyester resin, the shell layer contains a thermosetting resin, the thermosetting resin is a melamine resin or a urea resin, a ratio $G^*_1/G^*_2$ of complex modulus $G^*_1$ at 120° C. of a pellet formed using the toner relative to complex modulus $G^*_2$ at 120° C. of the toner is at least 2.0 and no greater than 3.0, the $G^*_1$ is at least $2.76 \times 10^4$ and no greater than $2.98 \times 10^4$, the $G^*_2$ is at least $1.03 \times 10^4$ and no greater than $1.38 \times 10^4$, the pellet is obtained by forming the toner into a size of 0.5 mm in thickness and 10 mm in diameter under forming conditions of 25° C. and 50 kg·f/cm$^2$, and the shell layer has a thickness of at least 3 nm and no greater than 20 nm.

2. The toner according to claim 1, wherein the toner core is anionic and the shell layer is cationic.

3. The toner according to claim 1, wherein the thermosetting resin is a melamine resin.

4. The toner according to claim 1, wherein a ratio tan $\delta_1$/tan $\delta_2$ of loss tangent tan $\delta_1$ at 120° C. of the pellet relative to loss tangent Tan $\delta_2$ at 120° C. of the toner is at least 0.30 and no greater than 0.50, the tan $\delta_1$ is at least 0.56 and no greater than 0.71, and the tan $\delta_2$ is at least 1.45 and no greater than 1.71.

5. The toner according to claim 1, wherein the thermosetting resin is a urea resin, and the shell layer has a thickness of 6 nm.

6. The toner according to claim 1, wherein the polyester resin has an acid value of at least 10 mg KOH/g and no greater than 40 mg KOH/g, the polyester resin has a hydroxyl value of at least 10 mg KOH/g and no greater than 20 mg KOH/g, the polyester resin has a glass transition point of at least 30° C. and no greater than 55° C., and the polyester resin has a softening point of no greater than 100° C.

7. The toner according to claim 6, wherein the polyester resin has an acid value of at least 40 mg KOH/g, the polyester resin has a hydroxyl value of 20 mg KOH/g, the polyester resin has a glass transition point of 48° C., and the polyester resin has a softening point of 100° C.

8. The toner according to claim 1, wherein the toner core has a glass transition point of 49° C., the toner core has a softening point of 90° C., and the toner core has a roundness of 0.93.

* * * * *